US006446852B1

(12) United States Patent
Sorensen et al.

(10) Patent No.: US 6,446,852 B1
(45) Date of Patent: Sep. 10, 2002

(54) BELT ASSEMBLY FOR STORAGE AND INVENTORY OF TOOLS

(75) Inventors: Joseph A. Sorensen; Charles Poremba, both of Bozeman; Rick De Francesco, Alder, all of MT (US)

(73) Assignee: WMH Tool Group, Inc., Palatine, IL (US)

( * ) Notice: Subject to any disclaimer, the term of this patent is extended or adjusted under 35 U.S.C. 154(b) by 0 days.

(21) Appl. No.: 09/750,468

(22) Filed: Dec. 28, 2000

(51) Int. Cl.[7] ..... A45F 5/00

(52) U.S. Cl. ..... 224/661; 224/236; 224/674; 224/677; 224/681; 224/682; 224/904

(58) Field of Search ..... 224/661, 904, 224/674, 677, 675, 681, 682, 684, 236, 240

(56) References Cited

U.S. PATENT DOCUMENTS

| | | | | | |
|---|---|---|---|---|---|
| D251,758 | S | | 5/1979 | Penrod | D2/381 |
| 4,303,187 | A | * | 12/1981 | Berman | 224/222 |
| 4,356,943 | A | * | 11/1982 | Berman | 224/222 |
| D276,476 | S | * | 11/1984 | Johansson et al. | D2/383 |
| 4,736,853 | A | * | 4/1988 | O'Mara | 211/88 |
| 4,796,790 | A | * | 1/1989 | Hamilton | 224/253 |
| 4,848,625 | A | * | 7/1989 | Lucia | 224/250 |
| 4,923,105 | A | * | 5/1990 | Snyder | 224/255 |

(List continued on next page.)

OTHER PUBLICATIONS

Materials printed from www.summitequipment.com website, 14 pages (no date of publication).
Network Solutions "Whois" search result for website www-.summitequipment.com, 2 pages (Jan. 2, 2002).
Color brochure/advertisement for Summit Equipment's The Wallaby Pack, 2 pages (no date of publication, however, published prior to the date of the filing of the instant application).

*Primary Examiner*—Stephen P. Garbe
(74) *Attorney, Agent, or Firm*—Fitch, Even, Tabin & Flannery

(57) ABSTRACT

A tool-carrying assembly to be secured by a waist-encircling belt, and, additionally, by straps encircling the legs of a workman using the belt assembly. The assembly is thus stabilized, and enhanced weight distribution is achieved. Elements of the belt assembly include a waist-encircling band supporting a pair of laterally spaced, depending panels each carrying tool-accepting pockets. The pockets preferably carry visual markings and coding as well as other indicia identifying clearly the specific tools to be "housed" or carried in and to be returned to each pocket after use. Inventory control of the tools is thereby significantly enhanced. Pivotal flaps depending from the band-carried panels serve to cover the tools when not in use, and to prevent the tools from scratching or otherwise marring any article, or fixture, or "workpiece" requiring the workman's attention. The panels and the tools carried thereby are disposed in lateral, spaced zones at the wearer's sides (and not directly in the front of one's body) thus further to reduce any likelihood of the tools coming into damaging physical contact with an article being worked upon. That is, both frontal and rearwardly located zones about the wearer of the tool belt assembly are rendered essentially free and clear of all tools and other mechanical impediments. While wearing the tool assembly of the invention, a worker can, without any discomfort, lie upon and use a "creeper". Significantly, a frontal sector of the belt itself is covered with a relatively soft, non-marring protective pad, composition, or surface material effective to prevent possible damage from a workman's belt buckle. An additional feature of the invention is that the panels may be structured to constitute a core sandwiched between a pair of encasing sheet-like webs. The resulting composite is readily formable to provide selectable visual patterns, designs or indicia, for example, to identify product name or sources and/or to constitute decorations.

32 Claims, 3 Drawing Sheets

U.S. PATENT DOCUMENTS

| | | | | | |
|---|---|---|---|---|---|
| D313,121 | S | | 12/1990 | Dise | D3/105 |
| 4,993,614 | A | * | 2/1991 | Bonofiglo | 224/253 |
| 5,152,443 | A | | 10/1992 | Hagan | 224/252 |
| 5,201,448 | A | | 4/1993 | Schue | 224/253 |
| D361,658 | S | | 8/1995 | Martin | D3/228 |
| 5,441,185 | A | | 8/1995 | Dragos | 224/151 |
| 5,470,000 | A | | 11/1995 | Muñoz | 224/224 |
| 5,497,923 | A | | 3/1996 | Pearson et al. | 224/253 |
| 5,505,356 | A | * | 4/1996 | Noriega et al. | 224/250 |
| 5,511,703 | A | | 4/1996 | Ryerson | 224/224 |
| 5,568,889 | A | * | 10/1996 | Holloway, Jr. et al. | 224/661 |
| D378,633 | S | * | 4/1997 | Granito | D3/228 |
| 5,653,337 | A | | 8/1997 | Cirigliano | 206/373 |
| 5,693,006 | A | * | 12/1997 | Slautterback | 224/587 |
| D410,773 | S | * | 6/1999 | Case | D3/228 |
| 5,964,386 | A | * | 10/1999 | Cote | 224/250 |
| 6,119,909 | A | * | 9/2000 | Dancyger | 224/683 |
| 6,179,185 | B1 | * | 1/2001 | Dancyger | 224/576 |
| 6,244,485 | B1 | * | 6/2001 | Holland et al. | 224/584 |

* cited by examiner

BELT ASSEMBLY FOR STORAGE AND INVENTORY OF TOOLS

FIELD AND BACKGROUND OF THE INVENTION

The present invention relates to a "TOOL SLINGER" belt assembly to be worn by a workman. More particularly, the invention is directed to a tool-carrying belt assembly to be secured about the wearer's waist, and stabilized, additionally, by means of straps encircling the legs of the workman using the belt assembly.

Trademen's tool belts of various types and for different specific or special uses and work projects are known in the art. Among these belts are utility belts for the attachment and support of tools and other accessories. Some of the belts are specially adapted for use by carpenters. Others are for electricians and for other definitive, limited or restricted applications such as wallpaper work. Many belt structures and configurations find more general utility. Some specific belt structures serve primarily as back supports for the wearer. In still other belt structures the back-support feature or capability provided is in addition to other work or trademen's functions.

The diversity and versatility of known tool belts notwithstanding, it is perceived that there exists a real and unsatisfied need for a tool belt which include sspecial structural configurations and tool pocket arrangements. Moreover, there is a need for tool belts in which the exposed belt surfaces are workpiece-protective, especially in tool belts for use by mechanics, includingm specifically, automobile mechanics.

SUMMARY OF THE INVENTION

The present invention relates to a belt assembly to be worn by a workman. The assembly takes the form of a body-carried structure for storage therein and for retrieval therefrom of mechanics' tools carried in pocket-like slots or pocket-like compartments of the assembly. The tool carrying assembly includes a readily adjustable belt-like band for encircling the wearer's waist. The band includes end sectors carrying adjustable inter-engaging coupling elements for converting the band into a closed loop to accommodate the waist measurement of the wearer. In a preferred embodiment of the invention the structural elements for securely and readily effecting the coupling of the band at its end sectors are releasably interengaging and locking "hooks" and "loops," or the Velcro type, for example.

It is a feature of the belt assembly of the invention that tool carriers at each of a pair of annularly spaced positions along the belt or band each comprise a closed-bottom panel formed with upwardly-opening compartments or pockets for housing selectable tools to be carried by the belt assembly. The pockets may be of various sizes and shapes to accommodate various tools such as wrenches, sockets and socket drives, pliers and screwdrivers, etc.

A structural feature and enhancement of the tool-carrying assembly of the invention consists of flaps which overlie a top opening of the tool storage compartments for securing the tool compartments and for covering protruding end portions of tools housed therein.

In one embodiment of the invention the laminated sections of the flaps constitute a multi-layer laminate which includes a sheet or layer of foam material sandwiched between a pair of bounding or enveloping sheets of a fabric type material. As so disposed or arranged, the laminate section is conveniently formable to establish a selectable physical surface configuration. The flap composition and structure described makes it feasible and practical to depict or to display a particular, selectable and stable physical configuration or design, or to print a legend, or to form other readily perceived indicia on the flaps of the tool holding compartment.

It is a feature of the invention that the flaps are hingedly pivotal for establishing, selectively, covered and exposed configurational modes of the tool compartments for facilitating protective storage of tools contained therein, and for enhancing ready retrieval of stored tools as desired.

Preferred embodiments of the present invention include structural elements for stabilizing the tool-holding belt assembly and for aiding in the weight distribution thereof. In the illustrative embodiments of the belt assembly shown, these stabilizing and weight distributing elements are depicted as wrap-around straps. The straps are secured to each panel of the assembly at each of a lower margin thereof for encircling and gripping, respectively, each of the workman's legs. Preferred adjustable fastening devices are strap-carried "hooks" and "loops."

Yet another feature of the belt assemblies is that the tool compartments include wall sections of formable thermoplastic compositions. In preferred embodiments of the invention the wall sections of the compartments comprise multi-layer laminated structures formed to present stable, outwardly-visible selectable indicia forcibly impressed and established therein. In some embodiments of the invention, the indicia are establisehd and presented in selectable distinguishable color codes. This arrangement serves as a useful aid in identifying the correct compartments for particular tools to be carried and stored in the tool holder.

Another feature of the tool-carrying belt assembly of the invention, uniquely appropriate and especially useful when the assembly is one worn by an automobile mechanic, is the provision, in the waist-encircling band, of a generally-centered, special lineal sector or section. This sector includes a relatively soft and exceedingly non-abrasive, outwardly-presented surface material. The latter prevents objectionable possible physical damage such as dents, abrasions and scratches, etc., resulting from forces impressed against an object or surface to be protected (such as the painted, highly-polished surfaces of an automobile) from physical abrasion and other damage during employment of the belt assembly when a mechanic or technician or other workman works on the automobile. This "padded," protective sector also overlies any belt buckle or similar fastener which may be worn by the user of the tool-carrying assembly, thus preventing any such structure from contacting and damaging the surface of an automobile, etc., on which the mechanic or technician may be working.

In preferred embodiments of the tool-carrying belt assembly of the invention, each panel and the tool compartment associated therewith is shiftable about and lockingly positionable at selectable locations on the waist-encircling band. Further, there are provided quick release devices for expeditiously freeing, and for re-locking, each panel, and so facilitating the repositioning of each panel on the band, as desired.

A convenient feature of the band itself of the belt assembly is that the band includes, at its end sectors, cooperating loop and hook fastener components. The latter are so disposed that the band may be folded over upon itself at an end portion thereof for establishing, reversibly, a selectable reduction in an effective length dimension of the band. By invoking the procedure described, one may adjust the effective length of the band to accommodate the waist sizes of different wearers of the belt assembly.

In one embodiment of the belt assembly the panels define holster-like, tool-carrying structures mounted to depend, respectively, at each body side zone of the wearer of the assembly. In the arrangement described, both the frontal and the rear zonal areas of the wearer's body are rendered essentially free of an unencumbered by belt-assembly-housed tools and other articles. The physical locations of the pocket-housed tools in their respective compartments, with no tools at his back, allows an automobile mechanic to lie on his back on a "crawler," without undue discomfort, when it is necessary for the mechanic to work on the underside of the automobile.

A useful and convenient feature of preferred embodiments of the invention is the provision, at zonal areas of compartments correlated with specific tools, of color-coded visual indicia or markings for identifying the tools to be contained or stored in each particular compartment. These permanent markings serve not only to save time, but constitute valuable aids facilitating inventory control.

In particular embodiments of the invention, the interiors of particular tool compartments are molded or otherwise formed to define cavity configurations conforming generally to exterior configurations of the specific tool to be housed in the compartment.

Yet another feature of embodiments of the invention is that the tool compartment carrying panels are arcuately formed or configured about a vertical axis to accommodate generally the gross shape or contour of the leg of a wearer of the tool belt assembly.

In preferred embodiments of the invention each tool-carrying panel is formed at an upper marginal zone thereof with a longitudinally-extending through slot defining a through passage for accommodating the belt-like band extending therethrough for supporting the panels at selectable annularly spaced positions about the band.

It is a safety feature of the tool carrying belt assembly of the invention that the flaps attached to the tool-carrying panels are each provided, on an under surface or underside thereof, with one component of a hook and loop fastener combination. Also, each panel carries, on a face portion presented to its overlying flap, a cooperating second component of a hook and loop fastener. The arrangement described serves as an assembly for positively securing the flaps as closures for the tool compartments, to retain each tool in its proper storage compartment, as desired.

Other and further objects, features and advantages of the invention will become apparent from the following detailed description considered in conjunction with the drawings.

DETAILED DESCRIPTION OF ILLUSTRATED EMBODIMENT

In accordance with the present invention, the aims and objects are achieved by providing a uniquely-configured tool-carrying assembly supported at and secured about the waist of a workman, for example, an automobile mechanic. Auxiliary support, stabilization and enhanced weight distribution are provided by adjustable, leg-encircling straps. The invention is characterized in that it is fabricated and configured to provide a generous number of readily accessible receptacles in the form of outwardly-presented, protected, upwardly opening slots, pockets or recesses. These are designed and sized for carrying therewithin a collection of selectable different tools of the type used, for example, by an automobile mechanic. The tool-housing, belt-supported, tool-carrying assembly is provided with protective covering flaps securable to overlie the encased tools to prevent loss and to protect the surface of the automobile or any other workpiece which may be involved.

Figure 1:
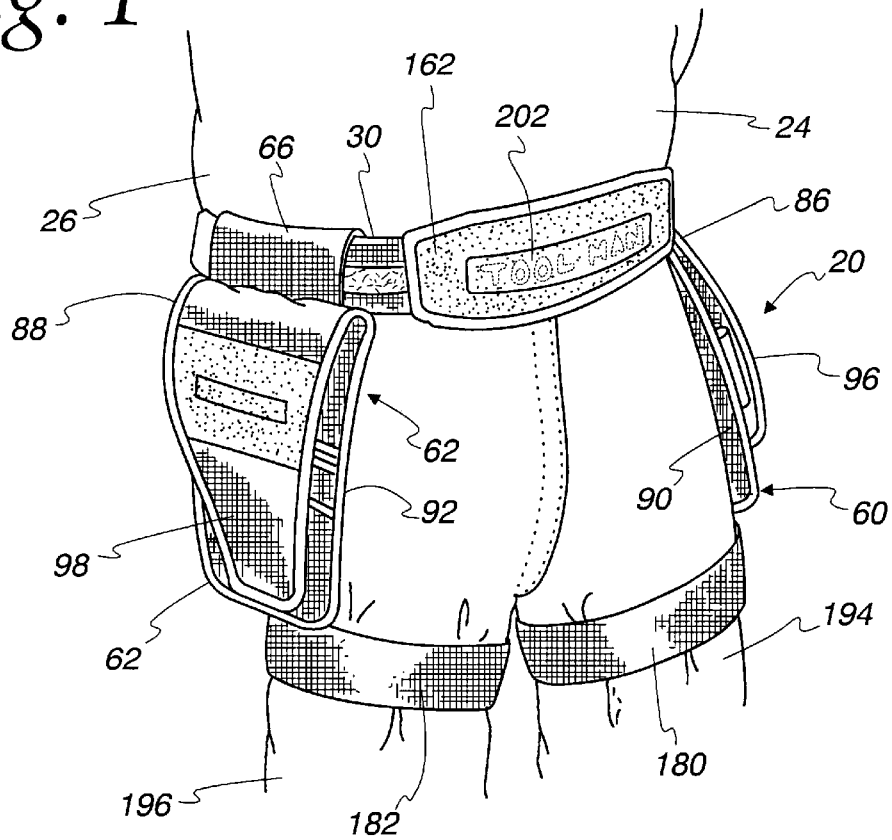
FIG. 1 is a slightly-angled front view showing the tool-carrying assembly of the invention secured about the waist of a workman such as a mechanic, and stabilized by leg-encircling, stabilizing straps as worn by a mechanic; and also showing opposed, laterally-positioned belt-supported tool-carrying packets, and a frontly-centered belt-carried workpiece-protective pad, all in accordance with the practice of the present invention.
Figure 2:
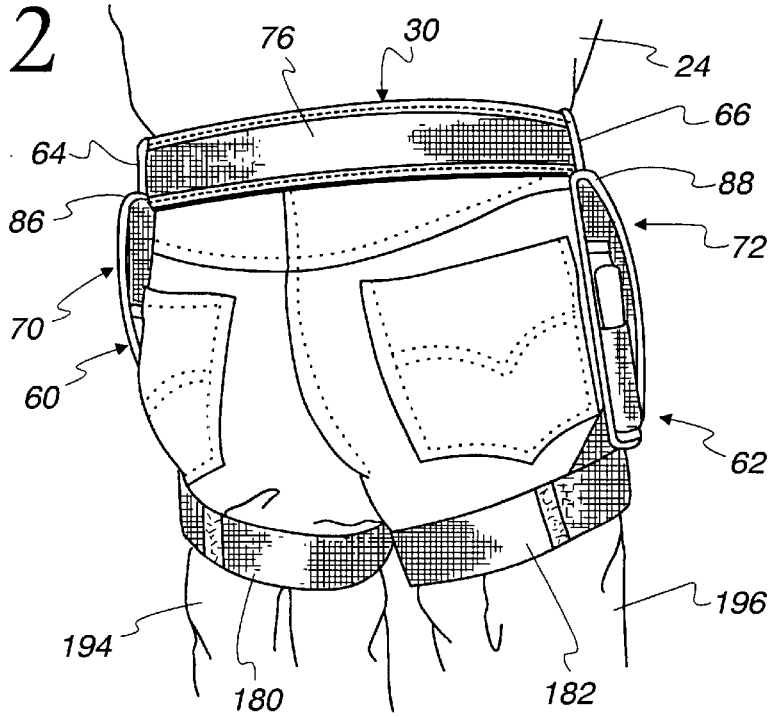
FIG. 2 is a view similar to FIG. 1 but taken from the rear of a wearer of a tool-carrying belt assembly according to the present invention.

Referring now to the drawings, for purposes of disclosure and not in any limiting sense, a preferred embodiment of the invention is shown in FIGS. 1 through 5 as a size-adjustable, tool-carrying assembly 20, shown in FIGS. 1 and 2 as fitted to a wearer 24, and secured about the wearer's waist 26.

The tool carrying assembly 20 includes a waist-encircling belt or band 30 lineal end zones 32 and 34 of which are provided, respectively, with cooperating hook and loop fastener elements 38 and 40 so that the belt 30 may be securely fastened about one's waist 26. In a preferred embodiment of the invention the hook and loop type fasteners 38 and 40 occupy significant areal expanses at each of lineal end sectors or segments 44 and 46 of the support belt 30. In the illustrated embodiment of the invention an end portion 50 of one end 52 of the belt 30 is formed with fastener elements 38 on each of its opposed sides so that one may fold that end 54 of the belt 30 over upon itself to effect an additional degree of shortening of the belt 30, as may be desired to accommodate a narrow-waisted wearer. Supported at laterally-spacially-separated generally frontal zones of the belt, are a pair of packets 56 and 58 which include belt-carried, depending panels 60 and 62. At the tops of each of the panels 60 and 62 are horizontally-disposed through loop sectors 64 and 66 through which the tool belt 30 is slidably trained. In the arrangement described, the panels 60 and 62 are slidably and adjustably positionable along the belt 30 to assume selectable positions at opposed waist or upper hip side zones 70 and 72 of the wearer of the tool carrying assembly 20 (FIGS. 1 and 2).

The back or rearwardly-presented section 76 of the belt 30 is preferably left free, clear and completely unencumbered, thereby to obviate any physical interference or impediments should the wearer/mechanic need to lie on his or her back on a "crawler", "creeper" or similar device in servicing or making repairs while working under an automobile, truck or other vehicle.

Figure 3:
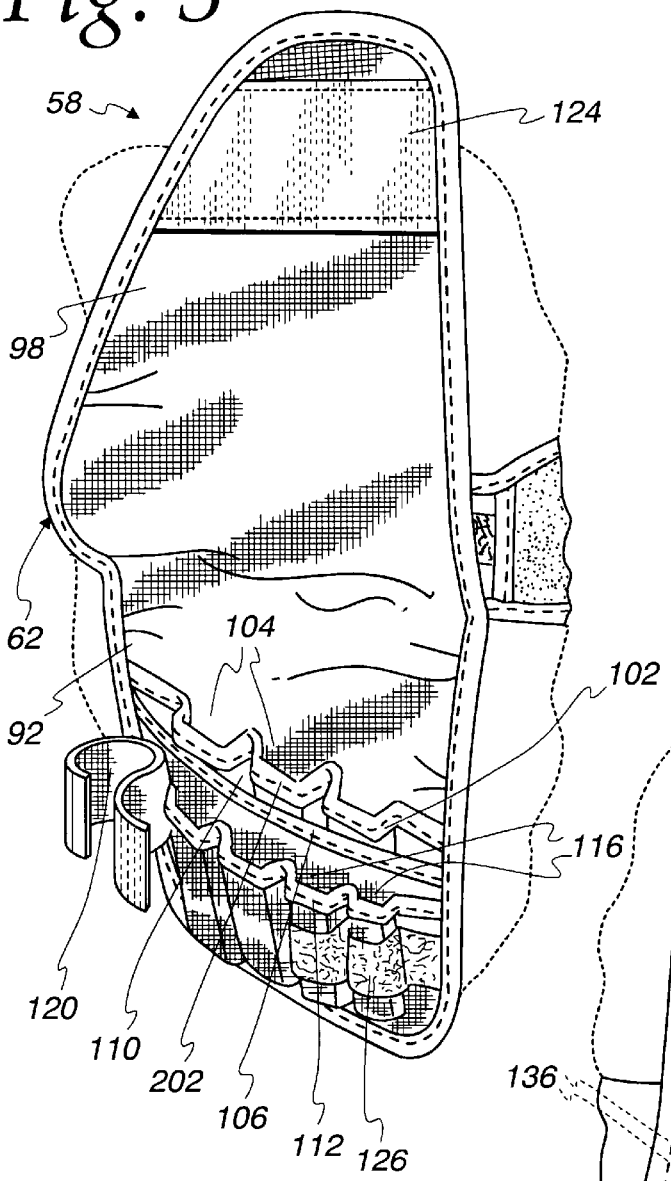
FIG. 3 is a fragmentary view showing one group of belt-carried pockets of the assembly of the invention for holding tools in accordance with the practice of the present invention.
Figure 4:
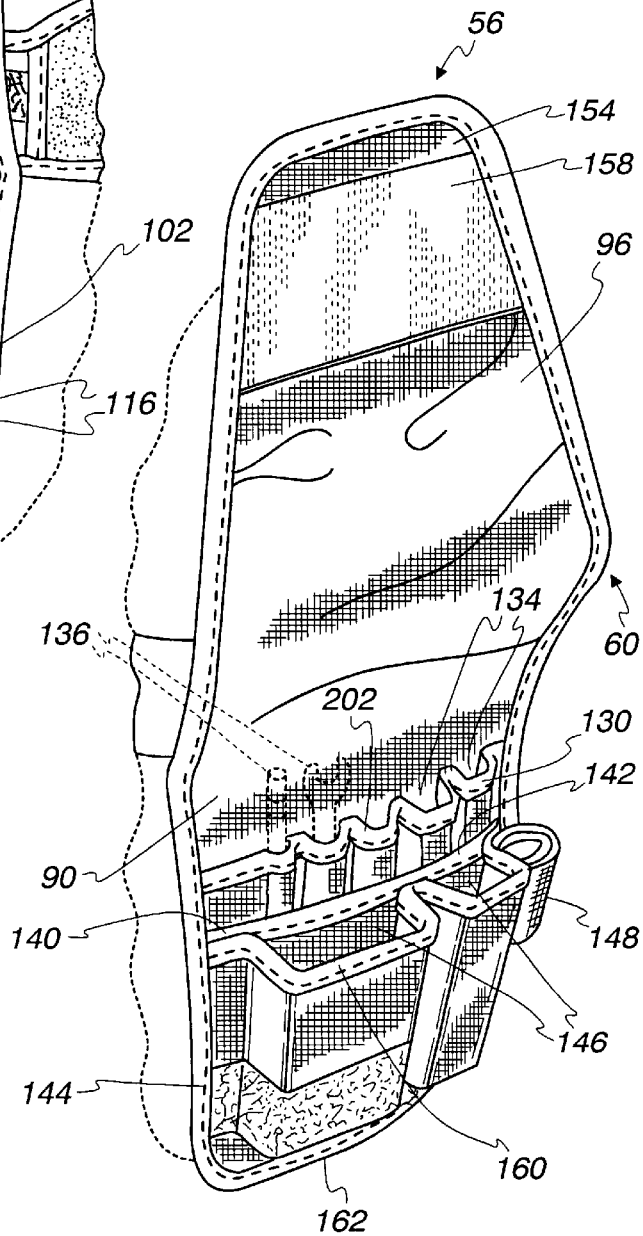
FIG. 4 is a view similar to FIG. 3 but showing a separate, second set of the tool-housing pockets in the tool-carrying assembly of the invention.
Figure 5:
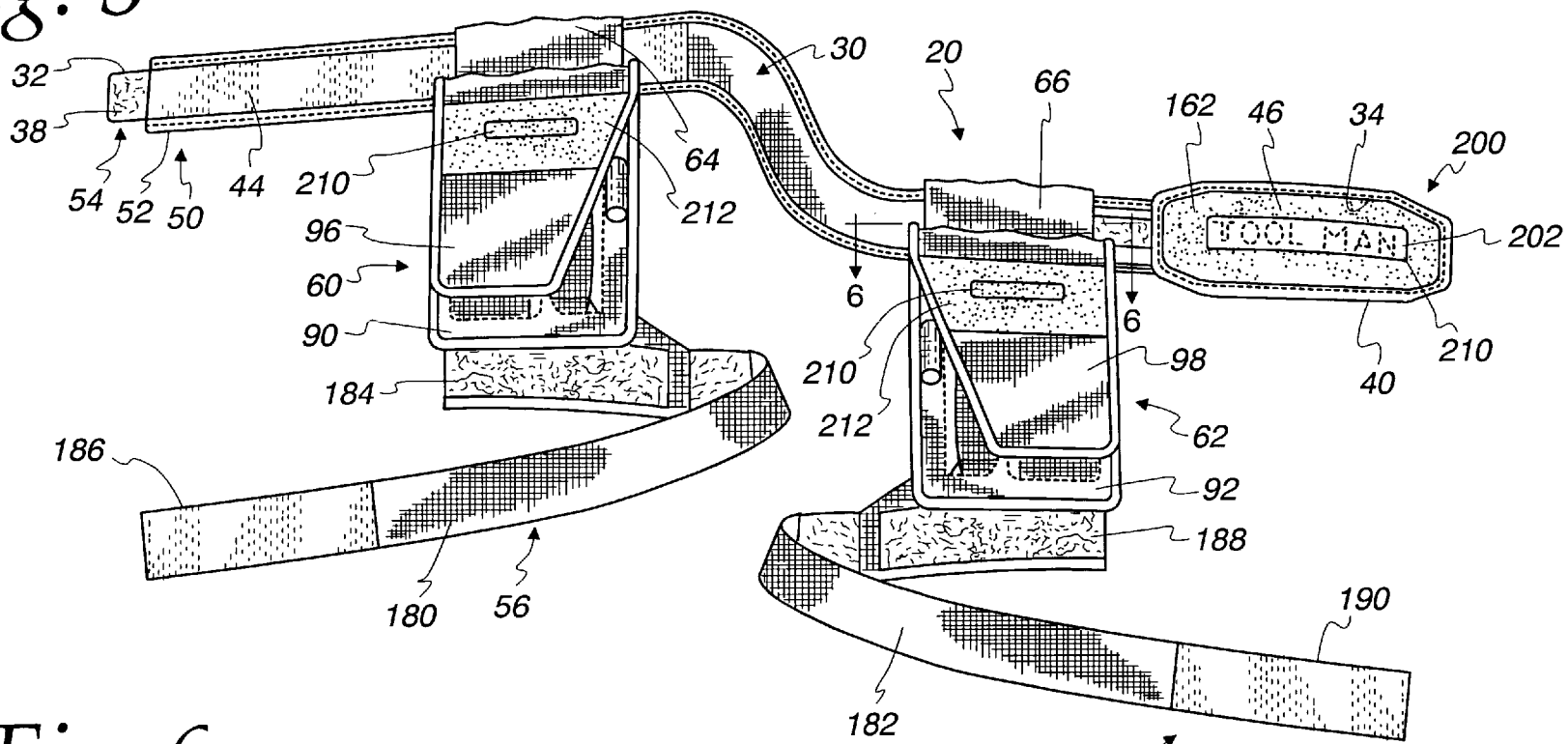
FIG. 5 is a perspective view of the tool-carrying belt assembly of the invention as it appears prior to its attachment about the waist of a wearer.

Components or elements of the tool carrying assembly 20 of the invention, evident in FIGS. 1 and 2, shown as belt-carried components in FIG. 5, and illustrated in more detail in FIGS. 3 and 4, include the tool-carrying or tool-housing packets 56 and 58 of the assembly 20. The panels 60 and 62 fastened to the loops 64 and 66 carried on the belt 30 are foldable or hinged 86 and 88 at respective lines of securement of the panels 60 and 62 to the belt-encircling loop sectors 64 and 66 to provide downwardly projecting lower sections 90 and 92 and upwardly positionable, downwardly foldable upper sections 96 and 98.

As shown in FIGS. 3 and 4, the panels 60 and 62 carry or support, in turn, secured in overlying relationship therewith, on the downwardly extending, lower sections 90 and 92 of the panels 60 and 62, a plurality of wall-defining webs. In the illustrated embodiment of the invention (FIG. 3) a first such web 102 is fashioned or formed to establish, with the panel 92, vertically extending and upwardly opening tool-receiving pockets or slots 104. A second web 106, overlying and substantially co-extensive with the first web 102, and secured at its base and at its lateral ends to the panel 92, defines, with the first web 102, a deep, full-width pocket 110 for holding other tools, etc. Fastened to the outer face of the second web 106 and to the principal panel 92 is an overlying third, outermost web 112 shaped or conformed to define with the second web 106 additional upwardly-opening recesses, slots or pockets 116 for accommodating additional tools to be stored therein. The illustrated embodiment of the invention also includes an adjustable, vertically-extending, wound, loop-forming, wrap-around strap or band 120 for accommodating yet another tool to extend therethrough and to be supported thereby. The overall arrangement described ensures ready access and retrieval of selectable tools as may be required by the user of the tool assembly. As seen in its upwardly configured mode, (FIG. 3), an upper areal zone or portion of the panel section 98 is provided with hooks (or loops) 124; as used in well-known fastener systems, for mating with a cooperating set of loops (or hooks) 126 provided at a base of the lower panel section 92. Thus the upper panel section 98 is readily foldable over to cover and to secure in place the tools carried in the various compartments of the packets 56 and 58 of the assembly 20.

A second arrangement of shaped pockets and other cavities for housing additional selectable tools is shown in FIG. 4. Again, the lower section 90 of the panel 60 depending from the belt-encircling loop 64 is formed with a series of overlying wall-defining webs which form, with the panel section 90, pockets or cavities serving as housings for the additional tools to be carried in the belt assembly 20. The uppermost, first web 130, overlying and secured at its lateral ends to the lower panel section 90 is formed to provide in cooperation with the panel section 90 of the panel 60 a series of laterally-spaced upwardly-open slots 134 for receiving and confining therewithin a series of selectable tools 136. A second web 140 secured at its lateral ends to the lower panel section 90 and overlying the first web 130 forms therewith a deep, wide pocket 142 for holding selectable items to be carried in the assembly 20. A third web 144 overlying the second web 140 forms therewith yet another group of laterally-spaced, upwardly opening slots 146 for housing yet an additional group of selectable tool items. Corresponding to structure above described with reference to the tool-holding devices of the invention, there is provided, outside of the third web 144 and attached thereto, a second vertically disposed, adjustable looped or rollable band 148 including cooperating hook and loop type fasteners for securing an additional tool element in place in the tool-carrying assembly 20.

In preferred embodiments of the invention, printed legends, other indicia or legible names or codings, preferably in different colors, are provided to identify, for selectable slots or compartments, the particular tool or other device to be housed therein. In accordance with the practice and teachings of the present invention, inventory control of the tools is significantly enhanced.

In a manner corresponding to that previously explained with reference to the first described tool-carrying unit (FIG. 3) of the invention, an upper, outwardly-presented face portion 154 of the panel 60 (FIG. 4) is provided with an areal expanse carrying one component 158 of a hook and loop type fastener combination. Upon folding the panel 96 downwardly and over upon itself to cover the tool-holding pockets, the fastener elements 158 lockingly (and releasably) engage cooperating mating fastener elements 162 covering a lower surface portion of the outwardly presented lower area of the tool receptacles.

The pivotal flaps 96 and 98 which overlie and cover the tools when not in use operate to prevent the tools from scratching or otherwise marring any workpiece requiring the mechanic's attention. Significantly and consistently, an enlarged frontal zonal area 162 of the overlying outwardly presented end sector 46 of the belt 30 itself presents a smooth, non-marring surface effective to prevent possible damage to a workpiece from a workman's belt buckle.

Referring now to FIGS. 1, 2 and 5, the tool-carrying belt assembly 20 includes wrap-around leg straps or bands 180 and 182 to encircle and positively to embrace or grip, respectively, by means of cooperating hook and loop elements 184, 186 and 188, 190, each leg 194 and 196 of a workman. As so disposed, the straps 180 and 182 function to stabilize the assembly 20 and to provide, as well, enhanced weight distribution thereof.

An additional useful feature of a preferred embodiment of the invention is that portions of the panels as well as the belt or waist-encircling band may be structured to constitute a somewhat enlarged, generally flat bodied expanse or sector 210 which may be layered and moldable. The resulting areal composite, such as the enlarged end component 200 of the belt is readily moldable or otherwise shaped, or may be stitched or imprinted or otherwise marked to form selectable visual patterns, legends, designs or indicia. The latter are significantly functional, for example, to identify or indicate product source, to designate a name, and/or to decorate 202.

In one embodiment of the invention the laminated sections of the flaps 96 and 98 constitute a multi-layer laminate 212 which includes a sheet or layer of foam material sandwiched between a pair of bounding or enveloping sheets of a fabric type material. As so disposed or arranged, the laminate section is conveniently formable to establish a selectable physical surface configuration. The flap composition and structure described makes it feasible and practical to depict or to display a particular, selectable and stable physical configuration or design, or to print a legend, or to form other readily perceived indicia on the flaps 96 and 98 of the tool holding compartment.

Figure 6:
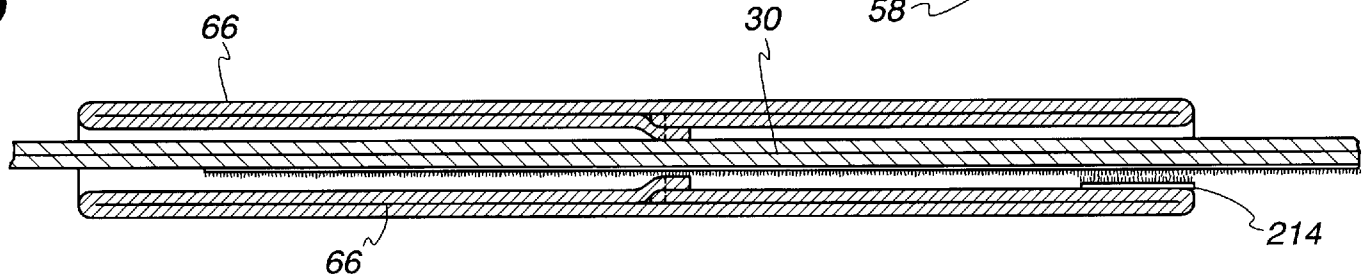
FIG. 6 is a cross-sectional view substantially on the lines 6—6 of FIG. 5 and depicting the structural arrangement of the belt and the belt-carried loops supporting the tool-receiving slots or pocket-like components of the invention.

As indicated in FIG. 6, the tool-carrying packets 56 and 58 are provided with surmounting, horizontally-extending through loops 64 and 66 which receive therethrough, and in sliding relation therewith the adjustable assembly-supporting belt 30 fixable about the mechanic's waist 26. In preferred embodiments of the tool-carrying belt assembly of the invention, there are provided quick release devices 214 for expeditiously freeing, and for re-locking, each panel 60 and 62, and so facilitating the repositioning of each panel on the band 30, as desired. In this way, each panel is shiftable about the band 30 and is lockably positionable at selectable locations on the band.

The subject invention has been illustrated in the drawings and described in cosiderable detail, all of which is to be considered illustrative and not restrictive. Only the preferred embodiment has been shown and described. All changes and modifications that come within the spirit of the invention are desired to be protected.

What is claimed is:

1. A belt assembly to be worn by a workman, the assembly being adapted for storage therein and for retrieval therefrom of workmen's tools to be carried therewithin, the belt assembly comprising:

a waist-encircling, belt-like band including end sectors for closing and for opening the band, and a forwardly-presented, generally-centered lineal sector including a relatively soft, non-abrasive outer surface material for protecting objects from possible physical damage resulting from pressure forces impressed against an object to be protected from physical abrasion and damage during a wearer's employment of the belt assembly;

means for securing the end sectors to one another to convert the band into a closed loop for encircling a waist of a wearer of the belt assembly;

a panel carried by and depending from the band at each of a pair of annularly spaced positions along the band, and each panel carrying upwardly-opening compartments for housing selectable tools to be carried by the belt assembly;

means secured to and depending from each panel from a zone above the compartments for overlying the compartments and for covering tools contained therein, said means for overlying and covering being hingedly pivotal for establishing, selectively, covered and exposed configurational modes for the compartments for facilitating protective storage of tools contained therein and for enhanced ready retrieval of stored tools for use of the tools as desired; and means secured to each panel at each of a lower margin thereof for encircling and gripping, respectively, each leg of a workman, for stabilizing the belt assembly and for providing enhanced distribution thereof.

2. A belt assembly as set forth in claim 1, wherein the compartments include wall sections of formable compositions.

3. A belt assembly as set forth in claim 2, wherein the wall sections of the compartments include outwardly-visible selectable indicia.

4. A belt assembly as set forth in claim 3, wherein the indicia are established and are presented in distinguishable color codes.

5. A belt assembly as set forth in claim 1, wherein each panel is shiftable about and is lockably positionable at selectable locations on the band, and further comprising quick release means for expeditiously freeing and for re-locking each panel for facilitating repositioning of each panel on the band, as desired.

6. A belt assembly as set forth in claim 4, wherein the band is formed at each end thereof with a lineal section of a loop and hook fastener component, and wherein the loop and hook fastener components allow at least a portion of each end of the band to be folded over upon itself at varying positions for effecting, reversibly, a selectable reduction in an effective length of the band, for accommodating waist sizes of different possible wearers of the belt assembly.

7. A belt assembly as set forth in claim 4, wherein the indicia include correlated color coding means for identifying specific tools to be housed in a corresponding specific selectable one of the components.

8. A belt assembly as set forth in claim 3, wherein the flap means includes a zone defining a multi-layer laminate, and wherein the laminate is formable to establish a physical configuration for depicting a visual design in the flap means.

9. A belt assembly as set forth in claim 1, wherein each panel defines a holster-like tool-carrying structure mounted to depend, respectively, at a side zone of a wearer, thereby to leave frontal zonal areas and rear zonal areas of a wearer's body essentially free of and unencumbered by belt-assembly-carried tools and other articles.

10. A belt assembly as set forth in claim 2, and further comprising, at zonal areas of the compartments and correlated with specific tools, means for facilitating inventory control for specific tools to be stored in the compartments and to be returned thereto after use.

11. A belt assembly as set forth in claim 2, wherein the compartments define interior configurations correlated with and generally conforming physically to exterior configurations of specific tool elements to be housed in the compartments.

12. A belt assembly as set forth in claim 1, wherein the panel is formed at upper marginal zones thereof with longitudinally-extending through slots defining means for accommodating the band threadedly extending therethrough for supporting the panels on the band at selectable annular positions along the band.

13. A belt assembly as set forth in claim 1, wherein the flap means carries on an underside thereof one component of a hook and loop fastener, and wherein the panel is formed in a lower zone thereof with an array of a cooperating other, second component of a hook and loop fastener for closedly securing the flap to cover tools carried in the compartments housing selectable tools.

14. A belt assembly to be worn by a workman, the assembly being adapted for storage therein and for retrieval therefrom of workmen's tools to be carried therewithin, the belt assembly comprising:

a waist-encircling, belt-like band having end sectors for closing and for opening the band, and a forwardly-presented, longitudinally-disposed, generally-centered lineal protective sector positioned to overlie any belt buckle or similar article worn by a user of the belt assembly, for preventing the buckle from directly contacting and damaging any article with which any such belt buckle might otherwise come into contact during a wearer's expected use of the belt assembly;

a fastener for securing the end sectors to one another to convert the band into a closed loop for encircling a waist of a wearer of the belt assembly;

a panel carried by and depending from the band at annularly spaced positions along said band, and carrying upwardly-opening compartments for housing selectable tools to be carried by the belt assembly;

a flap secured to and depending from the panel from a zone above the compartments for overlying the compartments and for covering tools contained therein, the flap being hingedly pivotal for establishing covered and exposed configurational modes for the compartments for facilitating protective storage of tools contained therein and for enhanced ready retrieval of stored tools for use of the tools as desired; and a leg strap secured to the panel at a lower margin thereof for encircling and gripping, a leg of a workman, for stabilizing the belt assembly and for providing enhanced distribution thereof.

15. A belt assembly to be worn by a workman, the assembly being adapted for storage therein and for retrieval therefrom of workmen's tools to be carried therewithin, the belt assembly comprising:

a waist-encircling, belt-like band including end sectors for closing and for opening the band, and a forwardly-presented, generally-centered lineal sector including a relatively soft, non-abrasive outer surface material for protecting objects from possible physical damage resulting from pressure forces impressed against an object to be protected from physical abrasion and damage during a wearer's employment of the belt assembly;

a fastener for securing the end sectors to one another to convert the band into a closed loop for encircling a waist of a wearer of the belt assembly;

a panel carried by and depending from the band located at an annularly spaced position along the band, and carrying an upwardly-opening compartment for housing selectable tools to be carried by the belt assembly;

a flap secured to and depending from the panel from a zone above the compartment for overlying the compartment and for covering tools contained therein, the flap being hingedly pivotal for establishing covered and exposed configurational modes for the compartment for facilitating protective storage of tools contained therein and for enhanced ready retrieval of stored tools for use of the tools as desired; and a leg strap secured to the panel at a lower margin thereof for encircling and gripping, respectively, a leg of a workman, for stabilizing the belt assembly and for providing enhanced distribution thereof.

16. A belt assembly as set forth in claim 15, wherein the compartment includes a wall section of formable composition.

17. A belt assembly as set forth in claim 16, wherein the wall section of the compartment includes outwardly-visible selectable indicia.

18. A belt assembly as set forth in claim 17, wherein the indicia are established and are presented in distinguishable color codes.

19. A belt assembly as set forth in claim 15, wherein the panel is shiftable about and is lockably positionable at selectable locations on the band, and further comprising quick release means for expeditiously freeing and for re-locking the panel for facilitating repositioning of the panel on the band, as desired.

20. A belt assembly as set forth in claim 15, wherein the band is formed at each end thereof with a lineal section of a loop and hook fastener component, and wherein the loop and hook fastener components allow at least a portion of each end of the band to be folded over upon itself at varying positions for effecting, reversibly, a selectable reduction in an effective length of the band, for accommodating waist sizes of different possible wearers of the belt assembly.

21. A belt assembly as set forth in claim 18, wherein the indicia include correlated color coding means for identifying specific tools to be housed in a corresponding specific selectable one of the components.

22. A belt assembly as set forth in claim 15, wherein the flap includes a zone defining a multi-layer laminate, and wherein the laminate is formable to establish a physical configuration for depicting a visual design in the flap.

23. A belt assembly as set forth in claim 15, wherein the panel defines a holsterlike tool-carrying structure mounted to depend, respectively, at a side zone of a wearer, thereby to leave frontal zonal areas and rear zonal areas of a wearer's body essentially free of and unencumbered by belt-assembly-carried tools and other articles.

24. A belt assembly as set forth in claim 15, and further comprising, at zonal areas of the compartment and correlated with specific tools, color-coded visual indicia for facilitating inventory control for specific tools to be stored in the compartment and to be returned thereto after use.

25. A belt assembly as set forth in claim 15, wherein the compartment defines an interior configuration correlated with and generally conforming physically to an exterior configuration of a specific tool element to be housed in the compartment.

26. A belt assembly as set forth in claim 15, wherein the panel is formed at upper marginal zones thereof with longitudinally-extending through slots defining through passages for accommodating the band threadedly extending therethrough for supporting the panel on the band at selectable annular positions along the band.

27. A belt assembly as set forth in claim 15, wherein the flap carries on an underside thereof one component of a hook and loop fastener, and wherein the panel is formed in a lower zone thereof with an array of a cooperating other, second component of a hook and loop fastener for closedly securing the flap to cover a tool carried in the compartment housing a selectable tool.

28. A belt assembly for storing tools comprising:

a waist-encircling, belt-like band including end sectors for closing and for opening the band, and a forwardly-presented, generally-centered lineal sector including a relatively soft, non-abrasive outer surface material for protecting objects from possible physical damage resulting from pressure forces impressed against an object to be protected from physical abrasion and damage during a wearer's employment of the belt assembly;

a fastener for locking the end sectors to one another to convert the band into a closed loop for encircling a waist of a wearer of said belt assembly;

a panel carried by and depending from the band, located at an annularly spaced position along the band, and carrying an upwardly-opening compartment for housing selectable tools to be carried by the belt assembly; and a flap secured to and depending from the panel from a zone above the compartment, for overlying the compartment and for covering tools contained therein, the flap being hingedly pivotal for establishing covered and exposed configurational modes for the compartment for facilitating protective storage of tools contained therein and for enhanced ready retrieval of stored tools for use of the tools as desired.

29. A belt assembly for storing tools comprising:

a waist-encircling, belt-like band including end sectors for closing and for opening the band;

a fastener for locking the end sectors to one another to convert the band into a closed loop for encircling a waist of a wearer of said belt assembly;

a panel carried by and depending from the band, located at an annularly spaced position along the band, and carrying an upwardly-opening compartment for housing selectable tools to be carried by the belt assembly;

a flap secured to and depending from the panel from a zone above the compartment, for overlying the compartment and for covering tools contained therein, the flap being hingedly pivotal for establishing covered and exposed configurational modes for the compartment for facilitating protective storage of tools contained therein and for enhanced ready retrieval of stored tools for use of the tools as desired; and a quick release mechanism connected to the panel for allowing the panel to be expeditiously secured to and released from the band and shiftably positioned about the band.

30. A belt assembly as set forth in claim 29, wherein the quick release mechanism comprises a fastener attached to a portion of the panel that is capable of making a secured connection with a mating fastener attached to the band, and wherein the secured connection can be made and released at one end of panel.

31. A belt assembly as set forth in claim 30, wherein the fastener and mating fastener comprise hook and loop fasteners.

32. A belt assembly for storing tools comprising:

a waist-encircling, belt-like band including end sectors for closing and for opening the band;

a fastener for locking the end sectors to one another to convert the band into a closed loop for encircling a waist of a wearer of said belt assembly;

a panel carried by and depending from the band, located at an annularly spaced position along the band, and carrying an upwardly-opening compartment for housing selectable tools to be carried by the belt assembly; and a flap made of a formable laminate for depicting a visual design in the flap wherein the flap is secured to and depends from the panel from a zone above the compartment, for overlying the compartment and for covering tools contained therein, the flap being hingedly pivotal for establishing covered and exposed configurational modes for the compartment for facilitating protective storage of tools contained therein and for enhanced ready retrieval of stored tools for use of the tools as desired.

* * * * *